United States Patent [19]

LeBegue et al.

[11] 4,339,153

[45] Jul. 13, 1982

[54] APPARATUS FOR EXTENDING AND RETRACTING THE CUTTER BARS OF A BORING TYPE MINING MACHINE

[75] Inventors: Maurice K. LeBegue, Argillite, Ky.; Earl C. Michael, Hoyleton, Ill.

[73] Assignee: National Mine Service Company, Pittsburgh, Pa.

[21] Appl. No.: 159,581

[22] Filed: Jun. 16, 1980

[51] Int. Cl.[3] ..... E21C 27/24

[52] U.S. Cl. ..... 299/59; 299/80; 175/89

[58] Field of Search ..... 299/57, 61, 80, 59; 175/89, 91

[56] References Cited

U.S. PATENT DOCUMENTS

| | | | |
|---|---|---|---|
| 2,711,889 | 6/1955 | Robbins | 299/80 |
| 2,719,709 | 10/1955 | Salmons | 299/57 |
| 2,743,093 | 4/1956 | Robbins | 299/61 X |
| 2,765,155 | 10/1956 | Evans et al. | 299/57 |
| 2,836,407 | 5/1958 | Tracy et al. | 299/59 |
| 2,890,033 | 6/1959 | Silks | 299/59 |
| 2,937,859 | 5/1960 | Jackson | 299/80 |
| 3,110,482 | 11/1963 | Ball | 299/57 X |
| 3,278,237 | 10/1966 | Karlovsky et al. | 299/59 |
| 3,278,238 | 10/1966 | Karlovsky et al. | 299/59 |
| 3,294,450 | 12/1966 | Karlovsky | 299/18 |
| 3,309,143 | 3/1967 | Karlovsky et al. | 299/57 |
| 3,309,144 | 3/1967 | Karlovsky | 299/60 |
| 3,350,137 | 10/1967 | Karlovsky | 299/61 |
| 3,376,072 | 4/1968 | Karlovsky | 299/59 |

*Primary Examiner*—Ernest R. Purser

*Attorney, Agent, or Firm*—Stanley J. Price, Jr.; John M. Adams

[57] ABSTRACT

A self-propelled boring type mining machine includes a mobile frame and a pair of spaced apart drive shafts that extend forwardly from a gear box mounted on the frame. A pair of rotary boring heads are nonrotatably connected to the pair of drive shafts and are operable to cut a pair of bores in a mine face to dislodge the mine material. Cusps formed at the mine roof and floor are dislodged by upper and lower cutter chains that are carried by upper and lower cutter bars movably positioned on the front end of the frame. Cutter bar extensions are movably positioned on both sides of the upper and lower cutter bars by control links pivotally connected to the extensions and the mobile frame. The upper and lower cutter bars are vertically extended and retracted by piston cylinder assemblies. Movement of the cutter bars is transmitted to the cutter bar extensions which are guided on the respective cutter bars along combined horizontal and vertical paths. Thus the cutter bar extensions are automatically moved to an operating position corresponding to a preselected position of the cutter bars for supporting the cutter chains in a preselected cutting position on the mobile frame.

8 Claims, 9 Drawing Figures

APPARATUS FOR EXTENDING AND RETRACTING THE CUTTER BARS OF A BORING TYPE MINING MACHINE

BACKGROUND OF THE INVENTION

1. Field of the Invention

This invention relates to a boring type mining machine and more particularly to the apparatus for automatically extending and retracting both the cutter bars and the cutter bar extensions by a single actuating means to a preselected position for supporting the cutter chains at the front end of the mining machine.

2. Description of the Prior Art

In boring type mining machines, as illustrated in U.S. Pat. No. 2,890,033, a pair of rotor cutter arms or boring heads are mounted on a pair of parallel positioned drive shafts that extend forwardly from a gear box at the front of the mining machine. Rotation of the drive shafts rotates the rotor arms to cut a pair of parallel bores in a seam of coal or mineral material to dislodge the material from a mine face. A conveyor mounted on the mining machine conveys the dislodged material rearwardly from the mine face for subsequent conveyance of the material out of the mine.

The boring action of the rotor arms leaves upstanding cusps on the floor and depending cusps at the roof. The cusps are cut off by endless chains that are rotated on the machine frame above and below the rotor arms. The chains are rotatably supported at the upper and lower corners of the frame by sprockets and the intermediate portions of the chains are guided within tracks of upper and lower cutter bars. Each cutter bar is retractable on the machine frame together with the sprockets to facilitate movement of the mining machine into and out of position opposite the mine face. Once the mining machine is in position, the cutter bars are vertically extended toward the mine roof and the mine floor respectively. The sprockets move outwardly toward the mine ribs to cut beyond the periphery of the rotor arms in order to dislodge the cusps.

It is the customary arrangement to provide power actuated extension means, such as piston cylinders, to extend and retract the cutter bars. The cutter bars are extended when the machine is in position at the mine face. The cutter bars are retracted to provide clearance at the mine roof and floor and at the mine ribs for maneuvering into a new cutting position or for withdrawing the machine from the mine face.

U.S. Pat. No. 2,890,033 discloses a first pair of piston cylinders for extending and retracting the upper cutter bar and a second pair of piston cylinders for extending and retracting the lower cutter bar. The first and second pairs of piston cylinders move the upper and lower cutter bars independently of the outward movement of the corner sprockets.

As further disclosed in the above patent, each of the corner sprockets that rotatably supports the cutter chains is extended and retracted by individual piston cylinders or jacks. This arrangement requires the careful coordination of the extension of the jacks for the sprockets with the extension of the piston cylinders for the cutter bars so that the the corner sprockets are extended to a position that corresponds to the cutting or working height of the cutter bars. The working height of the cutter bars is determined by the amount of extension of the cutter bar piston cylinders. Thus, once the cutter bars are extended to a selected working height, then each corner sprocket must be subsequently moved individually by the jacks to support the cutter chains at the desired working height.

This operation generally requires a number of adjustments to be made in the position of the corner sprockets to correspond to the position of the cutter bars. If the corner sprockets are not properly positioned relative to the extended cutter bars, the cutter chains will not be correctly positioned in the tracks of the cutter bars or on the chain guides. The chain links are then subjected to excessive wear thereby accelerating the need for repair or replacement. In addition, improper positioning of the corner sprockets relative to the cutter bars can place the cutter chains under excessive tension or generate excessive slack. This not only hastens wear of the chain but substantially reduces the effectiveness of the chains to dislodge the cusps from the mine face.

Therefore, there is need to provide in a boring-type mining machine, apparatus for automatically moving the corner sprockets inwardly and outwardly in response to movement of the cutter bars so that the corner sprockets are correctly positioned for supporting the cutter chains in the desired position as determined by the position of the cutter bars without requiring adjustments in the position of the sprockets after the cutter bars have been moved to a preselected position.

SUMMARY OF THE INVENTION

In accordance with the present invention there is provided a mining machine that includes a mobile frame. The mobile frame has a front end portion adapted to advance to a position opposite a mine face. A cutter chain carrying bar is movably positioned on the mobile frame front end portion. Power means mounted on the mobile frame front end portion moves the cutter chain carrying bar between a first position extended outwardly from the mobile frame and a second position retracted inwardly on the mobile frame. A chain guide member is carried by the cutter chain carrying bar. The chain guide member is positioned for lateral movement on the cutter chain carrying bar. Linkage means pivotally connected to the mobile frame moves the chain guide member laterally on the cutter chain carrying bar upon actuation of the power means. The linkage means is pivotably connected at one end to the mobile frame and is connected at the opposite end to the chain guide member. The power means is operable upon actuation to move the cutter chain carrying bar upwardly and downwardly to a preselected position between the first and second positions on the mobile frame front end portion. The linkage means is adapted upon movement of the cutter chain carrying bar to pivot on the mobile frame and move the chain guide member between a fully extended position and a fully retracted position relative the mobile frame to a preselected position corresponding to the preselected position of the cutter chain carrying bar.

Preferably a pair of upper and lower cutter chain carrying bars is movably positioned on the front end of the mobile frame and power means in the form of piston cylinders are connected at one end to the mobile frame and at the opposite end to each cutter chain carrying bar. Both the upper and lower cutter chain carrying bars include a pair of guide tracks through which a cutter chain runs. The ends of each cutter chain are reeved about at least one sprocket rotatably supported on a chain guide member positioned at each corner of the mobile frame front end portion. The upper and lower cutter chains are rotated about the sprockets on the chain guide members and through the guide tracks of the cutter chain carrying bars by a drive assembly mounted the mobile frame.

Actuation of the respective piston cylinders for each cutter chain carrying bar to either extend or retract the bars initiates extension and retraction of the chain guide members. The chain guide members are connected to the mobile frame by control links and move relative to the respective cutter chain carrying bars in both a vertical and horizontal direction. Thus, actuation of the cutter bar piston cylinders pivots the control links to move the chain guide members outwardly from the mobile frame automatically with movement of the cutter chain carrying bars.

Each chain guide member or extension includes a horizontal slot. A retainer secured to the respective cutter chain carrying bar is arranged to move in the slot. Thus upon extension of the cutter chain carrying bar the chain guide member moves in a horizontal direction as the control link pivots on the mobile frame. Consequently the chain guide member moves synchronously with the cutter chain carrying bar by operation of a single actuating means to a preselected position. In this manner the corner sprockets are correctly positioned to support the cutter chains at the desired position of the cutter chain carrying bars without requiring adjustments to be made in the position of the corner sprockets after the bars are moved.

As the chain guide members are retracted from an extended position slack generates in the cutter chains. The chain slack is taken up by chain take-up devices which include an arm member pivotably mounted at one end to the respective cutter chain carrying bar for movement relative to the respective chain guide member. A take-up roller is positioned at the opposite end of the take-up arm and is movable along an arcuate path with the take-up arm into and out of contact with the cutter chain. When the cutter chain carrying bars are retracted the take-up rollers are pivoted into contact with the chains and past the straight line path of the chains to remove from the chains slack which occurs when the cutter chain carrying bars are retracted.

Accordingly the principal object of the present invention is to provide in a boring-type mining machine apparatus for automatically moving the sprockets that rotatably support the cutter chain with extension and retraction of the cutter bars upon actuation of a single power means.

Another object of the present invention is to connect the chain guide members to the cutter chain carrying bars on a boring-type mining machine so that movement of the cutter chain carrying bars to a preselected position for supporting the cutter chains automatically moves the chain guide members to a corresponding position.

A further object of the present invention is to provide a boring-type mining machine that includes apparatus for automatically moving the chain sprockets and the chain take-up rollers in response to movement of the cutter chain carrying bars to a preselected position.

These and other objects of the present invention will be more completely disclosed and described in the following specification, the accompanying drawings, and the appended claims.

DESCRIPTION OF THE PREFERRED EMBODIMENT

Figure 1:
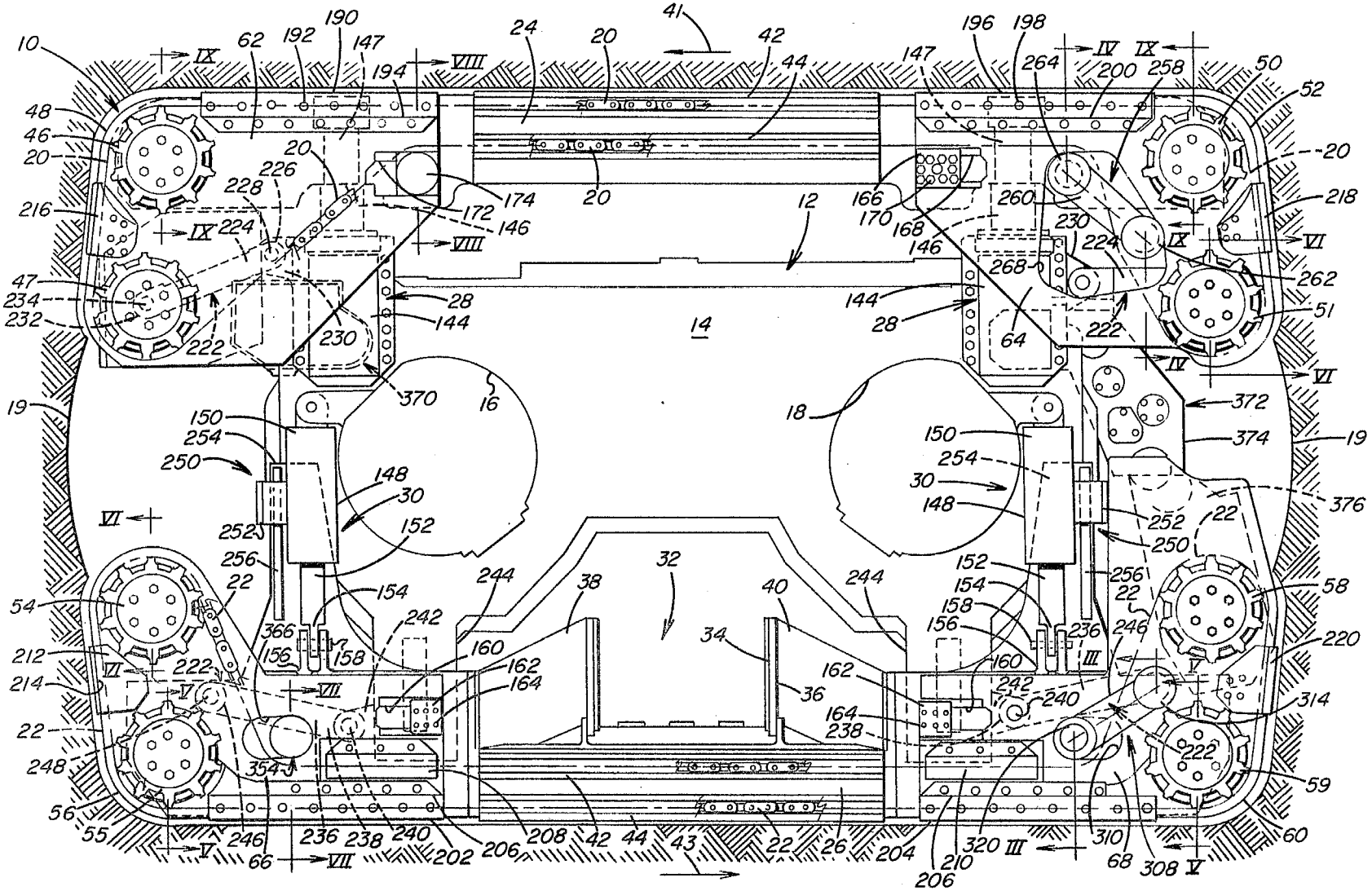
FIG. 1 is a front view of a mining machine, illustrating in an extended position movable upper and lower cutter bars that support and guide the intermediate sections of continuous cutter chains that are driven at their end portions by sprockets mounted on movable chain guide members which are linked to the bars.

Referring to the drawings and particularly to FIG. 1, there is illustrated the front end of a boring-type mining machine generally designated by the numeral 10 that includes a mobile frame generally designated by the numeral 12 mounted for movement on a propelling mechanism (not shown) such as crawler tracks in a manner well known in the art. The mobile frame 12 includes a gear box 14. The gear box 14 includes a pair of spaced openings 16 and 18 through which a pair of drive shafts (not shown) are arranged to extend and project forwardly from the gear box 14. A rotary cutting arm or boring head (not shown) is adapted to be nonrotatably connected to the front end of each drive shaft and is operable to cut a pair of parallel bores in a seam of coal or mineral material in an underground mine. With this arrangment the mining machine 10 is advanced by the crawler tracks in the mine to position the boring heads opposite the mine face from which solid material is dislodged and conveyed from the mine.

The boring action of the boring heads forms a generally semicircular wall or rib 19 on both sides of the machine. Also formed by the boring action are cusps upstanding from the mine floor and depending from the mine roof. These cusps are cut away by a pair of cutter chains 20 and 22 that are rotatably supported on the front end of the mobile frame 12 above and below the openings 16 and 18 for the boring heads, as illustrated in FIG. 1. The cutter chains 20 and 22 are partially shown in solid and are also diagrammatically illustrated by the — — — — lines in FIG. 1.

Figure 2:
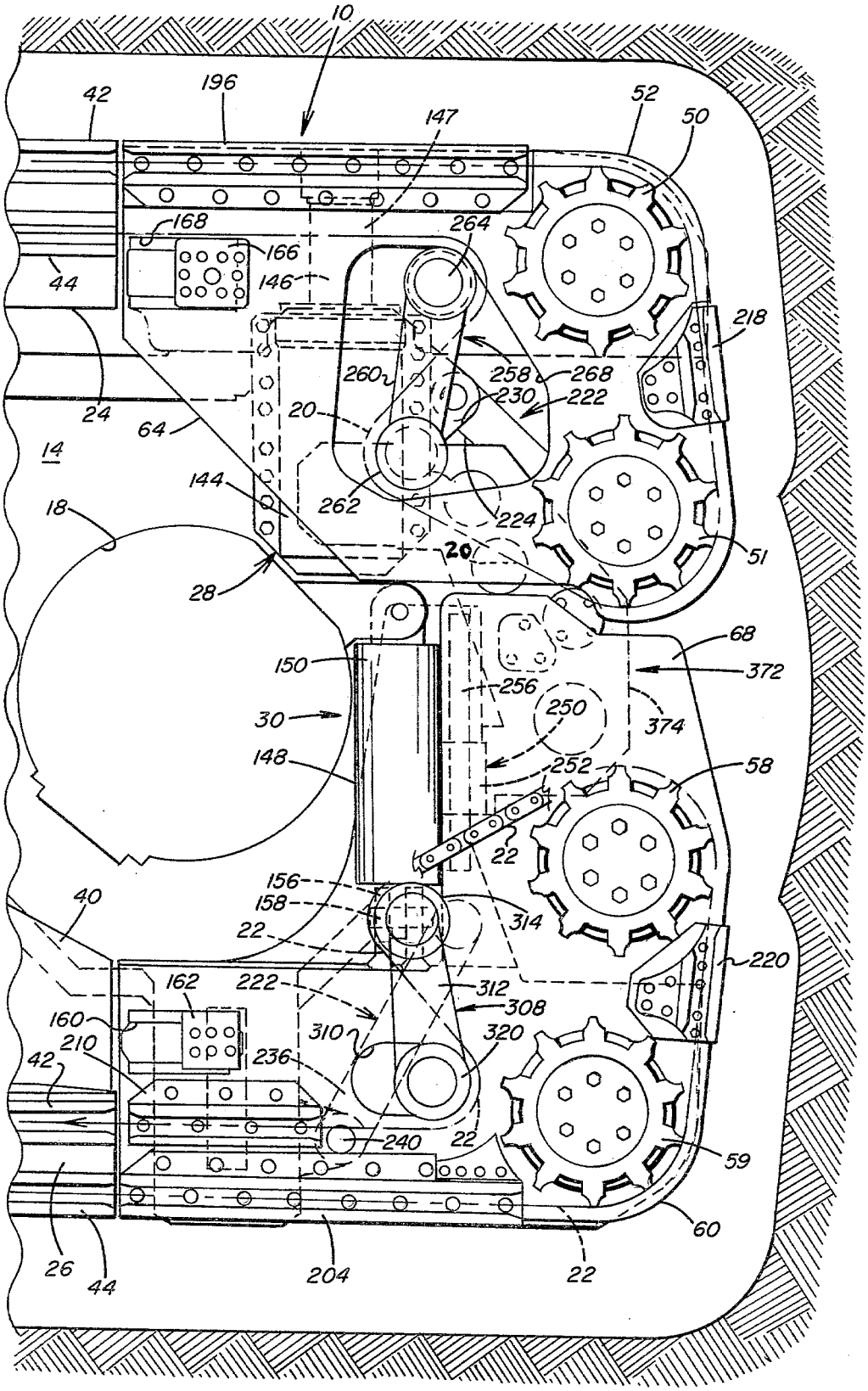
FIG. 2 is an enlarged fragmentary front view of the mining machine shown in FIG. 1, illustrating the upper and lower cutter bars and the corresponding chain guide members in a fully retracted position on the mining machine.

The upper and lower cutter chains 20 and 22 are carried by upper and lower chain carrying or cutter bars 24 and 26 respectively. The cutter bars 24 and 26 are supported for upward and downward vertical movement on the front end of the mobile frame 12 by pairs of suitable power actuated devices, such as a first pair of piston cylinder assemblies 28 for the cutter bar 24 and a second pair of piston cylinder assemblies 30 for the cutter bar 26. With this arrangement the cutter bars 24 and 26 together with the respective cutter chains 20 and 22 are movable between a fully extended position as illustrated in FIG. 1 and a fully retracted position as illustrated in FIG. 2. In the fully extended position of FIG. 1 the cutter chains 20 and 22 are positioned for obtaining the maximum cutting height in the mine for dislodging the cusps. The cutter bars 24 and 26 are accordingly retracted by the pistons cylinder assemblies 28 and 30 to the position illustrated in FIG. 2. In the retracted position clearance is provided at the top and bottom of the front end of the mobile frame 12 and at the sides of the frame 12 for maneuvering the mining machine 10 into and out of a cutting position opposite the mine face.

The solid material dislodged by the boring heads and the cutter chains 20 and 22 is conveyed rearwardly of the front end of the mobile frame 12 by a conveyor mechanism designated by the numeral 32. The conveyor mechanism 32 extends longitudinally on the mining machine 10 to a discharge end portion (not shown). The dislodged material is transferred to another vehicle or onto a conveyor for transporting the material out of the mine.

The conveyor mechanism 32 includes a trough 34 which supports an endless conveyor chain (not shown) which is driven in a conventional manner to move the dislodged material from an inlet opening 36 or receiving end portion of the trough 34 to the discharge end portion. The dislodged material is directed into the trough inlet 36 by a pair of pusher plates 38 and 40 which extend outwardly at an angle from the trough inlet 36 and are mounted on the bottom cutter bar 26. The pusher plates 38 and 40 direct the dislodged material into the trough inlet 36 and onto the endless chain conveyor.

The upper and lower cutter bars 24 and 26 each include an upper chain guide 42 and a lower chain guide 44. The chain guides 42 and 44 extend horizontally in spaced parallel relation on the respective cutter bars 24 and 26. The intermediate portions of the upper and lower reaches of the cutter chains 20 and 22 are positioned to move freely through the chain guides 42 and 44 and are maintained in a horizontal path of travel as they are rotated in a continuous path. The cutter chains 20 and 22 are arranged to travel in a preselected direction in the chain guides 42 and 44, for example the upper reach of the cutter chain 20 moves on the cutter bar 24 right to left as viewed by the arrow 41 in FIG. 1; while, the lower reach of the cutter chain 22 moves on the cutter bar 26 left to right as view by the arrow 43 in FIG. 1.

The cutter chains 20 and 22 are driven by a plurality of sprockets which are positioned at the upper and lower corners of the front end of the mobile frame 12. A first pair of sprockets 46 and 47 are positioned at a corner 48 and a second pair of sprockets 50 and 51 are positioned at a corner 52 on opposite sides of the upper cutter bar 24. In a similar arrangement a first pair of sprockets 54 and 55 are positioned at a lower corner 56 and a second pair of sprockets 58 and 59 are positioned at a corner 60 on opposite sides of the lower cutter bar 26. The end portions of the upper cutter chain 20 are thus reeved around the corner sprockets 46, 47 and 50,51. The lower cutter chain 22 is reeved around the lower corner sprockets 54, 55 and 58, 59.

The sprocket pairs 46, 47; 50, 51; 54,55; and 58, 59 are rotatably supported on chain guide members or cutter bar extensions 62, 64, 66, and 68 respectively. In accordance with the present invention, the chain guide members or extensions 62 and 64 are movably connected to the upper cutter bar 24, and similarly the chain guide members or extensions 66 and 68 are movably connected to the lower cutter bar 26. Thus, upon extension of the cutter bars 24 and 26 the extensions 62–68 move synchronously with the cutter bars 24 and 26 to a preselected working position by operation of a single actuating means, such as the pair of piston cylinder assemblies 28 for the upper cutter bar 24 and the pair of pistons cylinders 30 for the lower cutter bar 26.

Figure 5:
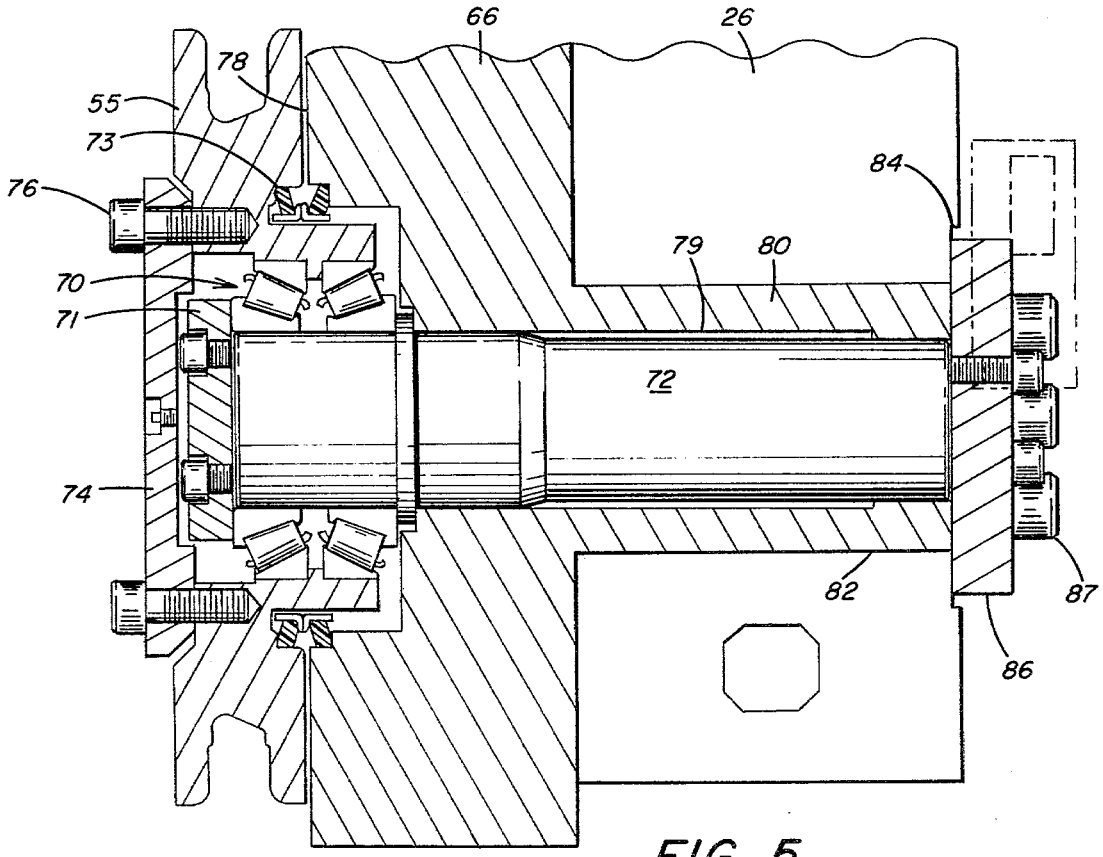
FIG. 5 is an enlarged fragmentary sectional view taken along line V—V of FIG. 1, illustrating one of the corner sprockets supported for movement by a chain guide member on the lower cutter bar.
Figure 6:
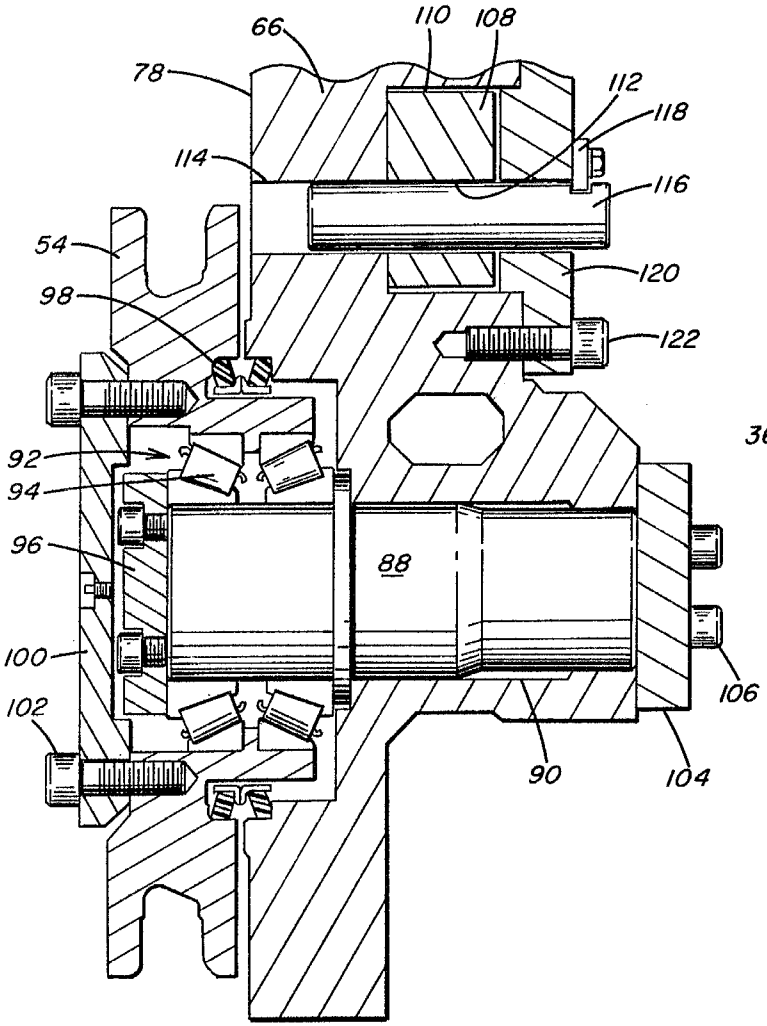
FIG. 6 is an enlarged fragmentary sectional view taken along line VI—VI of FIG. 1, illustrating the connection of one of the chain sprockets to a chain guide member positioned on the upper cutter bar.
Figure 9:
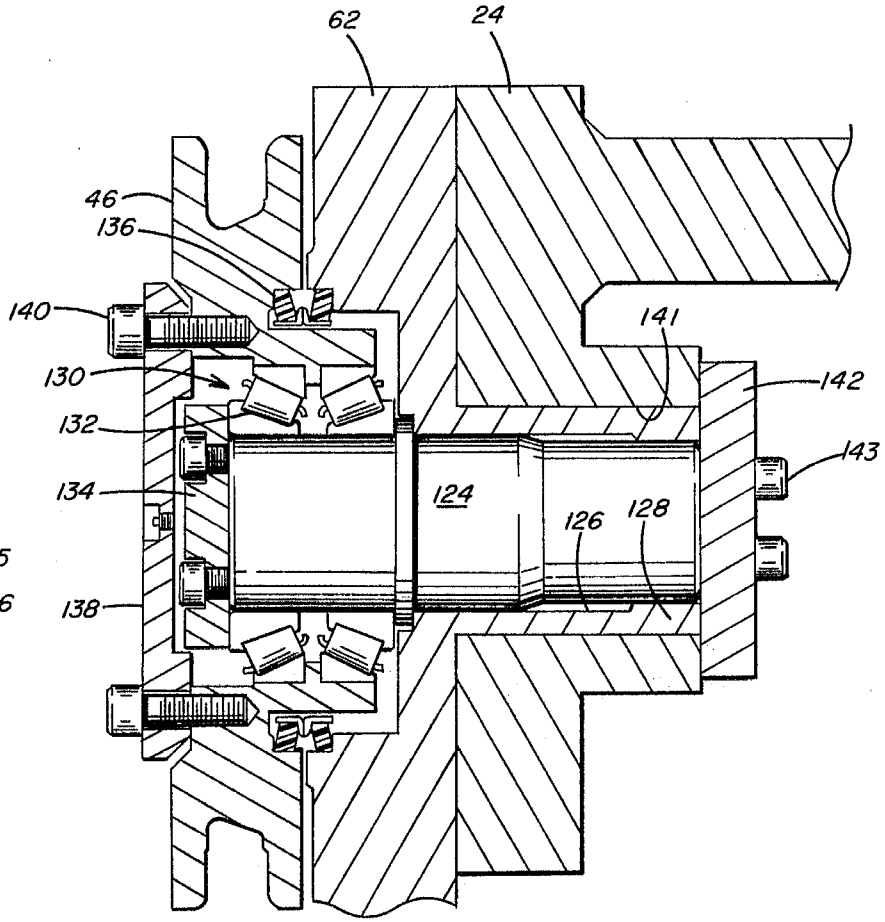
FIG. 9 is an enlarged sectional view taken along line IX—IX of FIG. 1, illustrating a sprocket rotatably positioned on a chain guide member supported on the upper cutter chain carrying bar.

The sprockets 46, 47, 50, 51, 54, 55, 58 and 59 are rotatably positioned on the respective extensions 62–68 as illustrated in FIG. 1 and in FIGS. 5, 6, and 9. The support for sprockets 46 and 50 is illustrated in FIG. 9, the support for sprockets 50 and 54 is shown in FIG. 6, and the support for sprockets 55 and 59 is illustrated in FIG. 5.

Now referring in detail to FIG. 5, there is illustrated the sprocket 55 rotatably mounted by a bearing assembly 70 on a shaft 72. The sprocket 55 is retained on the shaft 72 by a cap 74 which is connected by bolts 76 to the sprocket 55. The bearing assembly 70 includes a bearing carrier 71 connected to the shaft 72. A face seal 73 positioned between the sprocket 55 and the extension 66 seals the bearing assembly 70.

The shaft 72 is rotatably positioned within a bore 79 of the extension 66. The extension 66 has an outer surface 78 is as seen in FIG. 5, and clearance is provided between the outer surface 78 and the sprocket 55 to permit the sprocket 55 to rotate relative to the extension surface 78. Also as seen in FIG. 5, the extension 66 has a rectangularly shaped lower end portion 80 which extends through an opening 82 of the lower cutter bar 26. The lower cutter bar 26 is provided with a horizontal slot 84 positioned oppositely of the extension lower end portion 80. An extension retainer plate 86 is positioned in the slot 84. The retainer plate 86 is secured by a plurality of bolts 88 to the extension lower end portion 80.

With this arrangement upon actuation of the pair of piston cylinder assemblies 30, the extension 66 is movable horizontally within the slot 84 relative to the lower cutter bar 26. The above described arrangement for securing the sprocket 55 on the extension 66 and movably retaining the the extension 66 on the lower cutter bar 26 is also applicable for the connection of the oppositely positioned sprocket 59 on the extension 68. The extension 68 also moves horizontally relative to the lower cutter bar 26.

In an arrangement similar to the one described above, the sprocket 54 is also supported for rotation relative to the surface 78 of extension 66, as illustrated in FIG. 6. The sprocket 54 is rotatably supported on a shaft 88 that extends through a bore 90 of the extension 66. The sprocket 54 is rotatably positioned on the shaft 88 by a bearing assembly generally designated by the numeral 92 that includes roller bearings 94 retained on the end of the shaft 88 by a carrier 96 that is bolted to the end of the shaft 88. The roller bearings 94 are sealed by face seals 98 positioned between opposite surfaces of the sprocket 54 and the extension 66. The bearing assembly 92 is covered by a cap 100 that is secured by bolts 102 to the sprocket 54. At the opposite end of the shaft 88 an end plate 104 abuts the bottom of the extension 66 and is secured by bolts 106 to the end of the shaft 88 to close the bore 90 and further retain the shaft 88 on the bore 90.

Further as illustrated in FIG. 6 a stop 108 is positioned within a recess 110 on the lower surface of the extension 66. The stop 108 includes a bore 112 aligned with a bore 114 in the extension 66. A pin 116 extends through the aligned bores 112 and 114. The pin 116 is retained in place by a key 118 which is secured to a retainer 120. The retainer 120 extends into the extension recess 110 and abuts the lower surface of the extension 66. The retainer 120 is secured in this position to the extension 66 by a plurality of bolts 122, one of which is shown in FIG. 6. It should also be understood that the above described arrangement for mounting the sprocket 54 on the extension 66 is also applicable to the mounting of the sprocket 51 on the surface of the upper extension 64.

Now referring to FIG. 9 there is illustrated the arrangement for rotatably supporting the sprocket 46 on the extension 62 of the upper cutter bar 24. This arrangement is also applicable to the manner in which the sprocket 50 is mounted on the opposite extension 64. As seen in FIG. 9, the sprocket 46 is rotatably mounted on a shaft 124 that is positioned within a bore 126 that extends through a rectangular shaped lower end portion 128 of the extension 62. The sprocket 46 is rotatably positioned on the shaft 124 by a bearing assembly generally designated by the numeral 130 that includes roller bearings 132 retained on the outer end of shaft 124 by a carrier 134 which is secured to the end of the shaft 124. The bearings 132 are sealed by face seals 136 which sealingly engage opposite surfaces of the sprocket 46 and the extension 62. The bearing assembly 130 is covered on the sprocket 46 by a cap 138 secured by bolts 140 to the sprocket 46.

The extension lower end portion 128 is positioned in a slot 141 on the upper surface of the upper cutter bar 24. The end portion 128 together with the shaft 124 are movable horizontally in the slot 141. The end portion 128 and the shaft 124 are maintained in the slot 141 by a retainer 142 secured to the shaft 124 by bolts 143.

The upper and lower cutter bars 24 and 26 as seen in FIG. 1 are connected to the pairs of piston cylinder assemblies 28 and 30 respectively. The assemblies 28 for the upper cutter bar 24 include a cylinder portion 144 bolted to the gear box and an extensible piston rod 146 that extends from the cylinder portion 144 and is connected in a suitable manner at an outer end 147 to the extensible piston rod 146. Thus upon actuation of the assemblies 28 the piston rods 146 are extended from the cylinder portions 144 to move the cutter bar 24 together with the cutter chain 20 upwardly to a preselected position on the front end of the mobile frame 12. Also by retracting the extensible piston rods 146 into the cylinder portions 144 the upper cutter bar 24 and the chain 20 is retracted to a preselected position on the front of the mobile frame 12, as illustrated in FIG. 2.

Similarly the lower cutter bar 26 is extended and retracted at the bottom of the front end of the mobile frame 12 by operation of the piston cylinder assemblies 30. The piston cylinder assemblies 30 each include a cylinder portion 148 fixed at an end 150 to the gear box 14 and an extensible piston rod 152. The piston rod 152 is connected at an end 154 to a clevis 156 by a pin 158. The clevis is welded to the upper horizontal surface of the bottom cutter bar 26.

Upon actuation of the piston cylinder assemblies 30, the extensible piston rods 152 are moved from the position illustrated in FIG. 2 to the position illustrated in FIG. 1. In this manner the lower cutter bar 26 and the lower cutter chain 22 are moved from the fully retracted position of FIG. 2 to the extended position of FIG. 1. In addition, the lower cutter bar 26, as well as the upper cutter bar 24, is selectively movable to an intermediate position between the fully retracted position of FIG. 2 and the fully extended position of FIG. 1. The cutting position of the respective cutter bars 24 and 26 is determined by the working height at which the upper and lower cutter chains 20 and 22 are to be positioned for dislodging the cups that extend from the mine roof, floor, and ribs as a result of the boring action.

Not only are the chain guide members or extensions 62, 64, 66, and 68 movable vertically with the upper and lower cutter bars 24 and 26, the extensions are also movable laterally relative to the cutter bars 24 and 26. This is accomplished by linking the pair of upper extensions 62 and 64 to the upper cutter bar 24 and the pair of lower extensions 66 and 68 to the lower cutter bar 26 in a manner to carry out both horizontal and vertical movement on the respective cutter bars.

To this end, each of the lower extensions 66 and 68 includes a horizontal slot 160 as shown in FIG. 1. A retainer 162 extends through each slot 160 and is connected by bolts 164 to the surface of the lower cutter bar 26 positioned below the respective extension 66 and 68. The top of the retainer 162 overlies the upper surface of the respective extension 66 and 68 and is movable relative thereto. In this manner the respective extensions 66 and 68 are guided for movement in a horizontal direction on the lower cutter bar 26 by the retainer 162.

In a similar manner the upper pair of extensions 62 and 64 are guided for horizontal movement inwardly and outwardly on the upper cutter bar 24 by a retainer 166 that extends through a slot 168 provided in the upper extension 64. The retainer 166 is secured by bolts 170 to the upper cutter bar 24 positioned below the slot 168. The upper surface of the extension 64 opposite of the slot 168 slidably receives the lower surface of the retainer 166. With this arrangement the extension 64 is movable in a horizontal linear direction from the position illustrated in FIG. 2 where the retainer 166 is positioned at one end of the slot 168 to the position illustrated in FIG. 1 where the retainer 166 is positioned at the opposite end of the slot 168.

Similarly the upper extension 62 is retained for movement in a horizontal direction on the surface of the upper cutter bar 24. This is accomplished by providing a longitudinally extending slot 172 in the surface of the upper extension 62. This arrangement is illustrated in greater detail in FIG. 8 where a chain take-up roller 174 is positioned in the extension slot 172. The roller 174 is also operable as will be described later in greater detail to remove slack which is generated in the upper cutter chain 20 when the chain is retracted from the extended position in FIG. 1 to the retracted position in FIG. 2. The take-up roller 174 is rotatably mounted on a shaft 176 that is positioned in a bore 178 in the upper cutter bar 24. The shaft 176 is secured to the cutter bar 24 by a threaded member 180. In this manner the roller 174 is retained in a fixed position on the upper cutter bar 24. The upper extension 62 is then horizontally movable relative to the roller 174.

Figure 8:
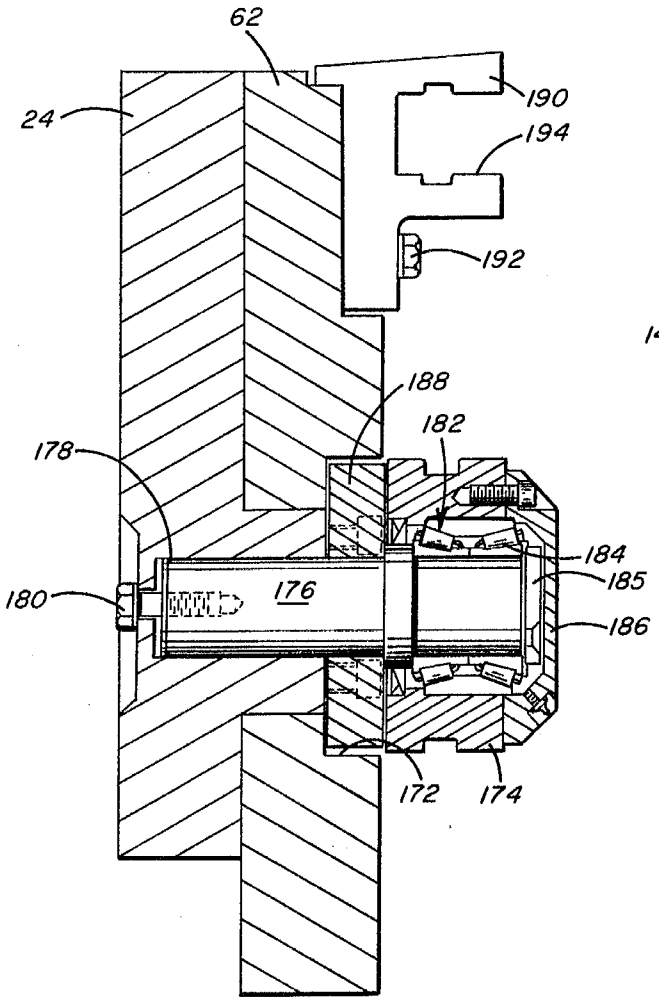
FIG. 8 is enlarged fragmentary sectional view taken along line VIII—VIII of FIG. 1, illustrating an arrangement similar to FIG. 7 for supporting a chain take-up roller for horizontal movement relative to one of the upper chain guide members.

The roller 174 is rotatably positioned on the outer end of shaft 176 as illustrated in FIG. 8 by a bearing assembly generally designated by the numeral 182. The bearing assembly 182 includes a pair of roller bearings 184 retained on the end of the shaft 176 by a bearing carrier 185 which is bolted to the end of shaft 176. The bearing assembly 182 is covered by a cap 186 bolted to the roller 174. A retainer 188 is positioned on the opposite side of the roller 174 and is bolted to the upper cutter bar 24. With this arrangement the upper extension 62 is movable horizontally on the cutter bar 24 relative to the retainer 188 and the roller 174. The extension 62 rides on the cutter bar 24 and is directed by the retainer 188 to move in a horizontal direction between the positions as illustrated in FIGS. 1 and 2.

Also as seen in FIG. 8 a chain guide member 190 is secured by bolts 192 to the upper horizontal edge of the extension 62. The guide member 190 includes a longitudinal channel-shaped recess 194 for receiving the upper reach of the upper cutter chain 20. The cutter chain 20 is positioned to move freely without obstruction through the channel 194 and extend in one direction around the sprocket 46 at the corner 48.

Similarly, at the opposite corner 52 on the upper cutter bar 24 a chain guide 196 is secured by bolts 198 to the upper horizontal edge of extension 64. As with the chain guide 190 the chain guide 196 includes a longitudinally extending, channel-shaped recess 200 for receiving the upper reach of the cutter chain 20. The cutter chain 20 extends in one direction from the chain guide 196 around the corner sprocket 50.

The lower extensions 66 and 68 are also provided with chain guides 202 and 204 respectively. The chain guides 202 and 204 are each bolted to the lower horizontal edge of the lower cutter bar 26 adjacent to the corner sprockets 55 and 59 respectively. Each chain guide 202 and 204 is provided with a longitudinal channel-shaped recess 206 for movably receiving the lower reach of the lower cutter chain 22.

Positioned oppositely of each of the chain guides 202 and 204 on the extensions 66 and 68 respectively are upper chain guides 208 and 210. The upper chain guides 208 and 210 are also bolted to the respective extensions 66 and 68 and are provided with longitudinally extending channel-shaped recesses for receiving the upper reach of the lower cutter chain 22. The upper reach of the lower cutter chain 22 extends through the upper chain guide 208 and around the sprocket 54 and through a further chain guide 212 secured to the extension 66 between the sprockets 54 and 55. The chain guide 212 also has a channel-shaped recess 214 for movably receiving the cutter chain 22 as it travels between the sprockets 54 and 55.

Each of the other extensions 62, 64, and 68 are provided with chain guides 216, 218, and 220 respectively similar to the chain guide 212 on the extension 66. For example, the chain guide 216 directs the upper reach of the upper cutter chain 20 between the sprockets 46 and 47. The chain guide 218 on the extension 64 at corner 52 directs the upper reach of the cutter chain 20 between the sprockets 50 and 51. Similarly, the chain guide 220 directs the lower reach of the lower cutter chain 22 between the sprockets 58 and 59 on the extension 68 at corner 60.

Upon actuation of the pairs of piston cylinder assemblies 28 and 30, the upper and lower cutter bars 24 and 26 respectively, are movable between a first or fully retracted position as illustrated in FIG. 2 and a second or fully extended position as illustrated in FIG. 1. Simultaneously with the movement, for example, to extend the cutter bars 24 and 26 to position the cutter chains 20 and 22 at a maximum cutting height, the respective pairs of extensions 62, 64 and 66, 68 are movable to positions corresponding to the positions of the cutter bars 24 and 26.

With this arrangement only a single actuating means, i.e. the pairs of piston cylinder assemblies 28 and 30, are required to carry out simultaneous and synchronous movement of the cutter bars 24 and 26 and extensions 62, 64, 66, and 68. Thus the extensions 62, 64, 66, and 68 are automatically moved to the proper working position for supporting the cutter chains 20 and 22 without requiring final adjustments in the position of the extensions once the cutter bars 24 and 26 are moved.

Figure 4:
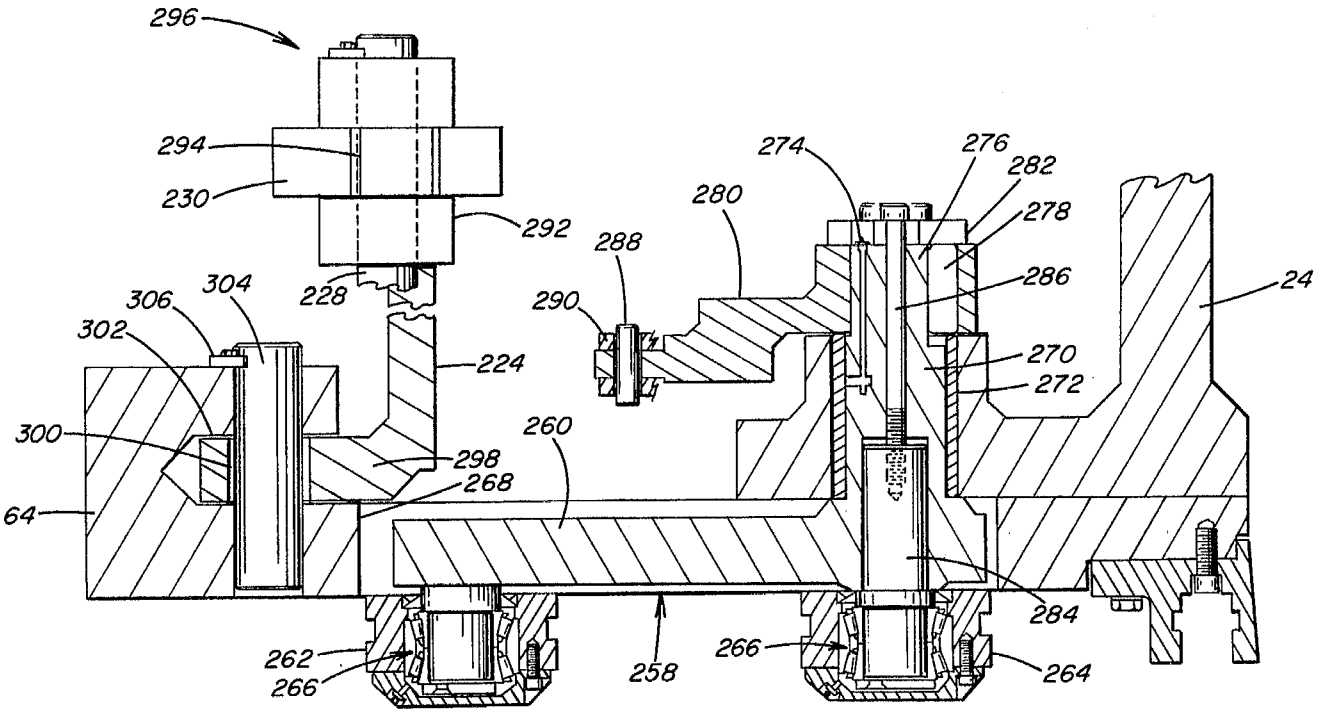
FIG. 4 is an enlarged fragmentary sectional view taken along line IV—IV of FIG. 1, illustrating a control link for moving a chain guide member in response to movement of the upper cutter bar and a further chain take-up assembly pivotably mounted on the upper cutter bar.

Lateral movement of the extensions 62, 64, 66, and 68 relative to the respective cutter bars 24 and 26 is accomplished by a linkage mechanism generally designated by the numeral 222 in FIG. 1 positioned beneath and connected to each of the extensions 62, 64, 66, and 68. Each of the linkage mechanisms 222 includes a control link 224. Each control link is pivotally connected at one end to the front end of the mobile frame 12 and at the opposite end to the under surface of the respective extension 62, 64, 66, and 68. An example of this connection is illustrated in FIG. 4 which will be described later in greater detail.

Referring to the control links 224 shown in FIG. 1 for the pair of upper extensions 62 and 64, each control link is connected at one end 226 by a pivot pin 228 to a bracket 230 that extends outwardly from the gear box 14. As discussed above the gear box 14 is rigidly mounted on the front end of the mobile frame 12. Also each of the control links 224 for the upper extensions 62 and 64 includes a second end 232 which is pivotally connected, as illustrated for the control link 224 on the extension 62, by a pivot pin 234 to the lower surface of the respective extension. The pivot pin for the second end of the control link 224 on the extension 64 is not illustrated in FIG. 1, but it should be understood that it is connected in a manner identical to the connection of the second end 232 of control link 224 on extension 62.

In a similar manner, as above described for the pair of upper extensions 62 and 64, the pair of lower extensions 66 and 68 are connected to the front end of the mobile frame 12 by linkage mechanisms 222 that include control links 236. Each of the control links 236 is connected at a first end 238 by a pivot pin 240 to a bracket 242 that extends outwardly from a lower forked end portion 244 of the gear box 14. A second end 246 of control link 236 is connected by a pivot pin 248 to the lower surface of the extension 66. In a similar arrangement for the opposite lower extension 68 in which like parts are designated by like numerals, a control link 236 is pivotally connected at a first end 238 by a pivot pin 240 to a bracket 242 extending from the forked end portion 244. A second end 246 of the control link 236 is connected by a pivot pin 248 to the lower surface of the extension 68.

With the above described linkage mechanisms 222 for connecting the extensions 62, 64, 66, and 68 to the front end of the mobile frame 12, upon actuation of the respective pairs of piston cylinder assemblies 28 and 30 to extend the respective piston rods 146 and 152 the control links 224 and 236 pivot in an arcuate path about their respective pivot points on the mobile frame 12. In FIG. 2 the control links 224 and 236 are shown in the pivoted positions corresponding to the fully retracted position of the extensions 62, 64, 66, and 68 on the upper and lower cutter bars 24 and 26. When the piston cylinder assemblies 28 and 30 are actuated from the position illustrated in FIG. 2 to the position illustrated in FIG. 1, the control links 224 and 236 pivot from the position illustrated in FIG. 2 to the position illustrated in FIG. 1.

The pivotal movement of the control links 224 and 236 results in horizontal movement of the extensions 62, 64, 66, and 68 to thereby extend and retract the extensions laterally on the cutter bars 24 and 26. This movement of the extensions 62, 64, 66, and 68 occurs synchronously with the movement of the upper and lower cutter bars 24 and 26 from the position illustrated in FIG. 2 to the position illustrated in FIG. 1. Thus extension and retraction of the cutter bars 24 and 26 results in corresponding extension and retraction of the extensions 62, 64, 66, and 68.

The movement of the extensions 62, 64, 66, and 68 is restrained to follow a combined horizontal and vertical path. Movement of the extensions 62, 64, 66, and 68 in a vertical path is accomplished by movement of the respective extensions with the vertical movement of the cutter bars 24 and 24. The extensions 62, 64, 66, and 68 move vertically with the cutter bars 24 and 26 because they are connected to the cutter bars 24 and 26 by positioning of the retainer 166 in the slot 168 of extension 64, the take-up roller 174 in the slot 172 of extension 62, and the retainers 162 in the slots 160 of the pair of lower extensions 66 and 68.

As the extensions 62, 64, 66, and 68 move both vertically and horizontally relative to the front end of the mobile frame 12, the cutter bars 24 and 26 are restrained to vertical movement. The upper cutter bar 24 moves vertically toward and away from the gear box 14 from the position illustrated in FIG. 2 to the position illustrated in FIG. 1. The lower cutter bar 26 also moves vertically inwardly and outwardly from the gear box 14 from the position illustrated in FIG. 2 to the position illustrated in FIG. 1.

The movement of the lower cutter bar 26 by actuation of the piston cylinder assemblies 30 is restrained to vertical linear movement by provision of a cutter bar guide generally designated by the numeral 250. A cutter bar guide 250 is associated with each of the respective pair of piston cylinder assemblies 30, as shown in FIG. 1. Each cutter bar guide 250 includes a sleeve-like retainer 252 that is suitably secured, as by bolting, to the gear case 14. The lower cutter bar 26 includes a pair of upwardly extending arm members 254 which are positioned in underlying relation with the piston cylinder assemblies 30. Suitably secured to and extending upwardly from each arm member 254 is a guide bar 256. The guide bar 256 extends through the sleeve-like retainer 252.

Upon actuation of the piston cylinder assemblies 30 to extend the piston rods 152 the guide bars 256 move relative to the retainers 252 from the position illustrated in FIG. 2 to the position illustrated in FIG. 1. With the retainers 252 secured to the gear case 14, the guide bars 256 are maintained in a vertical plane as they move in the retainers 252. This, in turn, maintains movement of the lower cutter bar 26 in a vertical plane on the front end of the mobile frame 12. Also it will be apparent that a similar arrangement can be provided for the upper cutter bar 24.

As the upper and lower cutter bars 24 and 26, as well as the extensions 62, 64, 66, and 68 are retracted from the position illustrated in FIG. 1 to the position illustrated in FIG. 2 slack is generated in the upper and lower cutter chains 20 and 22. The slack must be removed and a substantially uniform tension maintained on the cutter chains 20 and 22 in both the extended and retracted positions to reduce wear of the chain components. Therefore, suitble take-up chain devices are connected to the upper and lower cutter bars 24 and 26 to move with the respective cutter bars 24 and 26 and automatically remove slack generated in the cutter chains 20 and 22.

As above discussed, the upper cutter bar 24 at the corner 48 is provided with a take-up roller 174 that is rotatably mounted in a fixed position on the upper cutter bar 24. As the extension 62 moves laterally the lower reach of the upper cutter chain 20 on the extension 62 is moved laterally into and out of contact with the take-up roller 174. As illustrated in FIG. 1, in the fully extended position of extension 62, the take-up roller 174 is removed from contact with the lower reach of the cutter chain 20. When the extension 62 is retracted to the position illustrated in FIG. 2, the slack which is generated in the cutter chain 20 is removed by movement of the cutter chain 20 into contact with the take-up roller 174. The cutter chain 20 is thus diverted from a straight line path and the slack is taken up.

The extension 64 is also provided with a take-up mechanism generally designated by the numeral 258 which is illustrated in FIGS. 1 and 2 and in greater detail in FIG. 4. Referring to FIG. 4, the take-up mechanism 258 includes a take-up arm 260 that rotatably supports on its surface a pair of take-up rollers 262 and 264. The rollers 262 and 264 are suitably connected to the take-up arm 260 by conventional roller bearing assemblies 266. As illustrated in FIGS. 1 and 2, the upper extension 64 is provided with a cut-out opening 268 in which the take-up arm 260 is positioned to permit the take-up rollers 262 and 264 to extend beyond the upper surface of extension 64.

The take-up arm 260 includes a support shaft portion 270 that extends rearwardly of the arm 260 at the point where the take-up roller 264 is connected to the take-up arm 260. The shaft portion 270 extends through bushing 272 which is retained in a bore through the upper cutter bar 24. A lubricant fitting 274 extends through the end of the shaft portion 270 and into communication with the interior of the bushing 272 to provide delivery of lubricant between the abutting surfaces of the bushing 272 and the shaft portion 270 to permit rotation of the shaft portion 270 within the bushing 272.

The shaft portion 270 includes an end portion 276 which is secured by a key 278 to the end of a take-up arm 280. The shaft end portion 276 is also connected to the take-up arm 280 by a cap 282. Also connected to the support shaft portion 270 is a shaft 284 for supporting the bearing assembly 266 of take-up roller 264. The shaft 284 is connected to the support shaft portion 270 of take-up arm 260 by a threaded member 286 that is secured to and extends through the cap 282 on the shaft end portion 276.

Thus with the above described arrangement, one end of the take-up arm 280 is connected to the support shaft portion 270 of the take-up arm 260. The opposite end of the take-up arm 280 is connected by a pivot pin 288 to a clevis end portion 290 of a hydraulically actuated piston cylinder assembly (not shown). The piston cylinder assembly upon actuation initiates pivotal movement of the take-up arm 280 and consequently pivotal movement of the support shaft portion 270 on the upper cutter bar 24. This pivotal movement is transmitted to the take-up arm 260 and the take-up rollers 262 and 264 for movement within the cut-out opening 268 of the extension 64.

The construction and operation of the hydraulically actuated piston cylinder assembly associated with the take up arm 280 and connected at its extensible end portion by the pivot pin 288 to the clevis 290 is similar to that illustrated in FIG. 3, which will be described hereinafter in greater detail. The operation of the piston cylinder assembly for the take-up arm 280 is controlled by the hydraulic system of the mining machine 10. When the cutter bar 24 and the upper extensions 62 and 64 are retracted from the position illustrated in FIG. 1 to the position illustrated in FIG. 2, the piston cylinder assembly extends its piston rod to pivot the take-up arm 280 so that the support shaft portion 270 pivots within the bushing 272 in the cutter bar 24 to pivot the take-up arm 260.

Pivoting of the take-up arm 260 moves the take-up roller 262 from a position removed from contact with the lower reach of the upper cutter chain 20 into contact therewith. In this manner the slack generated in the upper cutter chain 20 when the upper cutter bar 24 and the extensions 62 and 64 are retracted is removed. Also as above described when the upper cutter bar 24 and the extensions 62 and 64 are retracted the take-up roller 174 engages the cutter chain 20 to remove slack in the cutter chain 20 on the extension 62. The action of removing slack in the upper cutter chain 20 takes place simultaneously with the operation of the piston cylinder assemblies 28 when the piston rods 146 are retracted into the cylinder portions 144.

Also illustrated in FIG. 4 is the movable connection of the control link 224 to the extension 64. The conrol link 244 includes a first end portion 292 mounted on the pivot pin 228, which extends through aligned bores in the control link first end portion 292 and the bracket 230 mounted on the mining machine gear box 14. The pivot pin 228 is positioned within a bushing 294 of the bracket 230. The opposite end of the pivot pin 228 extends from the bushing 294 into a retainer assembly generally designated by the numeral 296. With this arrangement the control link 224 is mounted for pivotal movement on the pivot pin 228 upon actuation of the piston cylinder assemblies 28.

The control link 224, as further illustrated in FIG. 4, includes a second end portion 298 that is provided with a bore for receiving a bushing 300. The control link second end portion 298 is retained within a slotted recess 302 of the extension 64. A pin 304 extends through the aligned bores of the control link bushing 300 and the extension 64. The pin 304 is securely retained within the aligned bores of the extension 64 and bushing 300 by a retainer 306 secured to the extension 64 and the end of the pin 304.

With this arrangement the control link second end portion 298 is pivotal on the pin 304. Upon actuation of the piston cylinder assemblies 28 the control link 244 is pivoted about its connection to the machine gear box 14 to carry the extension 64 in a horizontal path as the assemblies 28 move the cutter bar 24 and the extension 64 vertically. It should also be understood that the above described connection for the control link 224 to the gear box 14 of the mining machine 10 and the extension 64 is also applicable for the connection of the control link 224 to the extension 62 and the gear box 14 at the opposite corner 48, as well as, the connection of the control links 224 to the extensions 66 and 68 and the gear box 14 at corners 56 and 60 respectively.

Figure 3:
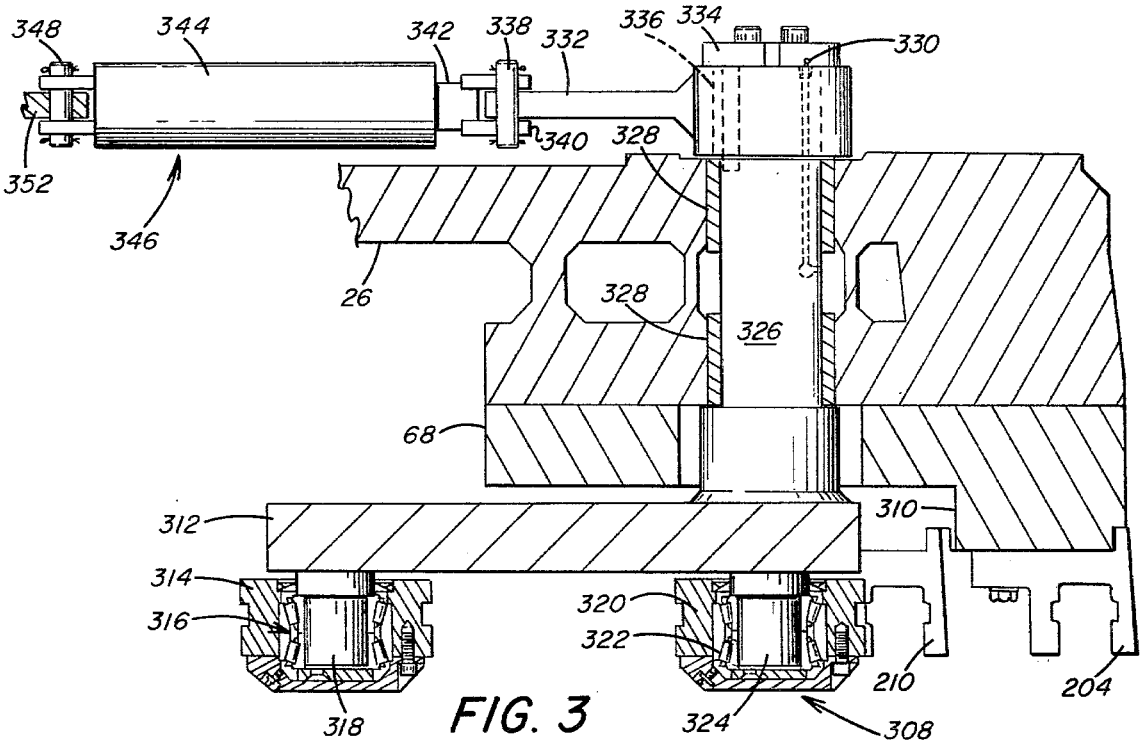
FIG. 3 is an enlarged fragmentary sectional view taken along line III—III of FIG. 1, illustrating a chain take-up assembly for removing slack in the cutter chain in response to movement of the lower cutter bar.

Now referring to FIG. 3, there is illustrated a take up device generally designated by the numeral 308 for removing slack in the lower cutter chain 22 mounted on the lower extension 68. The extension 68 includes a cut-out opening 310, and a take-up arm 312 extends through the opening 310. The take-up arm 312 is positioned in an overlying relation with the surface of extension 68 for pivotal movement between the position illustrated in FIG. 1 and the position illustrated in FIG. 2. As shown in FIG. 2, the take-up device 308 is operable to remove slack generated in the cutter chain 22 upon retraction of the lower cutter bar 26 and the extension 68.

A first take-up roller 314 is rotatably mounted by a bearing assembly 316 on a shaft 318 extending outwardly from the take-up arm 312. In a similar arrangement a second take-up roller 320 is rotatably mounted on a bearing assembly 322, which is supported by a shaft 324 extending outwardly from the opposite end of the take-up arm 312.

The take-up arm 312 includes a support shaft portion 326 that extends through the opening 310 of the lower extension 68 and is rotatably retained within a bushing 328 of the lower cutter bar 26. Lubricant is supplied through a fitting 330 into the bushing 328 to permit pivotal movement of the support shaft portion 326 within the bushing 328. The outer end of the support shaft portion 326 is retained on a take-up arm 332 by an end cap 334 and a key 336, which is positioned within a key-way of the support shaft 326 and the end of the take-up arm 332.

The take-up arm 332 is connected at an opposite end by a pivot pin 338 to a clevis end portion 340 of a piston rod 342. The piston rod 342 extends from a cylinder 344 of a hydraulically actuated piston cylinder assembly generally designated by the numeral 346. The cylinder portion 344 is pivotally connected by a pivot pin 348 to a bracket 352 mounted on the machine frame 12.

With this arrangement the hydraulically actuated piston cylinder assembly 346 shown in FIG. 3 is operable to pivot the take-up roller 314 into and out of a take-up position relative to the lower cutter chain 22 as illustrated in FIGS. 1 and 2. Both of the take-up devices 258 and 308 on the upper and lower extensions 64 and 68 are operable when the upper and lower cutter bars 24 and 26 are retracted to remove the slack generated in the chains 20 and 22. In this manner substantially uniform tension is maintained on the chains 20 and 22 in both the extended and retracted positions.

Figure 7:
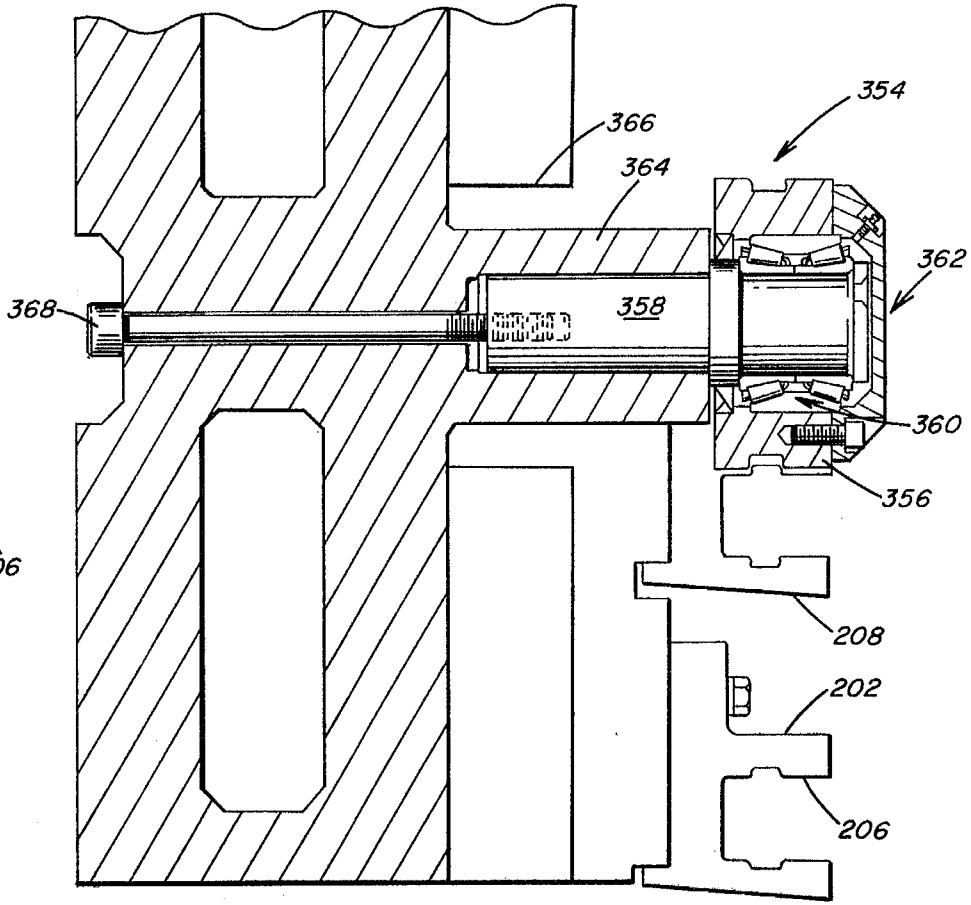
FIG. 7 is an enlarged fragmentary sectional view taken along line VII—VII of FIG. 1, illustrating a chain take-up roller positioned on the bottom cutter bar and movable horizontally within a slot of the chain guide member.

A further take-up device, generally designated by the numeral 354 in FIGS. 1 and 7, is provided on the lower extension 66 to take up the chain slack generated in the lower cutter chain 22 when the lower cutter bar 26 and the extension 66 is retracted to the position illustrated in FIG. 2. The take-up device 354 is operable in a manner above described for the take-up roller 174 illustrated in FIG. 1 for removing slack in the upper cutter chain 20 on the extension 62.

As illustrated in greater detail in FIG. 7, the chain take-up device 354 includes a take-up roller 356 that is rotatably mounted on the end of a shaft 358 by a bearing assembly 360 and a retainer cap 362. The shaft 358 is positioned within a tubular portion 364 of the lower cutter bar 26. The cutter bar tubular portion 364 extends upwardly through a slot 366 cut in the upper surface of the lower extension 66. A threaded member 368 extends through the lower cutter bar 26 for connection with the shaft 358 to thereby retain shaft 258 securely on the lower cutter bar 26. With this arrangement the take-up roller 356 is rotatably mounted on the lower cutter bar 26, and the lower extension 66 is movable relative to the take-up roller 356 as the extension 66 moves laterally between the positions illustrated in FIGS. 1 and 2.

When the lower extension 66 is extended laterally from the cutter bar 26, the take-up roller 356 is moved to the position relative to the upper reach of the lower cutter chain 22 as illustrated in FIG. 1. However, when the lower extension 66 is retracted to the position illustrated in FIG. 2, the cutter chain 22 is displaced by the roller 356 from a straight line path between the roller 356 and the sprocket 54 to an arcuate path therebetween so that the generated slack is removed from the chain 22 as shown in FIG. 2. Contact of the take-up roller 356 with the cutter chain 22 to remove slack from the chain 22 takes place automatically upon retraction of the piston cylinder assemblies 30 in the same manner as above described for the take-up roller 174 and the take-up devices 258 and 308.

As the cutter bars 24 and 26 are moved between the extended and retracted positions together with the extensions 62, 64, 66, and 68. The respective cutter chains 20 and 22 are rotatably driven in a preselected direction around the sprockets 46, 47, 50, 51, 54, 55, 58, and 59. The sprockets are rotated by the rotor arm drive through the gear box 14.

As illustrated in FIG. 1, the gear box 14 includes a drive assembly generally designated by the numeral 370 which is secured to the gear case 14 in underlying relation with the upper cutter bar 24 and the extension 62. The drive assembly 370 is mounted in a gear case and is drivingly connected to the rotor drive shaft that extends through the opening 16 and a driven sprocket (not shown) associated with the drive assembly 370. The driven sprocket associated with the drive assembly 370 engages the upper cutter chain 22. Thus upon rotation of the rotor arm drive shaft the upper cutter chain 20 is rotated in a continuous path in a preselected direction around the respective sprockets and through the respective chain guides.

In a similar arrangement to the lower cutter chain 22, a drive assembly generally designated by the numeral 372 is mounted on the opposite side of the gear box 14 in underlying relation with the upper extension 64. The drive assembly 372 includes a gear case 374 that is connected to the gear box 14 and includes a drive train drivingly connected to the rotor arm drive shaft that extends through the opening 18. The drive train of gear case 374 is drivingly connected to a final drive train positioned within a gear case 376 connected to the gear case 374. The final drive of the gear case 376 is connected to a driven sprocket (not shown) which engages the lower cutter chain 22. The lower cutter chain 22 is driven around the sprockets 54, 55, 58, and 59 in a continuous path in a preselected direction simultaneously and coordinated with rotation of the upper cutter chain 20 around the sprockets 46, 47, 50, and 51.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A mining machine comprising, a mobile frame, said mobile frame having a front end portion adapted to advance to a position opposite a mine face, a cutter chain carrying bar movably positioned on said mobile frame front end portion, power means mounted on said mobile frame front end portion for moving said cutter chain carrying bar between a first position extended outwardly from said mobile frame and a second position retracted inwardly on said mobile frame, a chain guide member carried by said cutter chain carrying bar, said chain guide member being positioned for lateral movement on said cutter chain carrying bar, a control link pivotally connected to said mobile frame for moving said chain guide member laterally on said cutter chain carrying bar upon actuation of said power means, said control link being pivotally connected at one end to said mobile frame and connected at the opposite end to said chain guide member, said chain guide member having a horizontal slot, retainer means connected to said cutter chain carrying bar and positioned in said horizontal slot to permit said chain guide member to move horizontally relative to said retainer means and said cutter chain carrying bar, said power means being operable upon actuation to vertically move said cutter chain carrying bar to a preselected position between said first and second positions on said mobile frame front end portion, said retainer means being vertically movable with said cutter chain carrying bar to transmit vertical movement to said chain guide member, said control link being adapted upon movement of said cutter chain carrying bar to pivot on said mobile frame and move said chain guide member between a fully extended position and a fully retracted position relative to said mobile frame to a preselected position corresponding to the preselected position of said cutter chain carrying bar, and said chain guide member being restrained to vertical and horizontal movement upon pivoting of said control link by the engagement of said retainer means in said horizontal slot as said chain guide member moves vertically to move said chain guide member along a combined horizontal and vertical path simultaneously with movement of said cutter chain carrying bar.

2. A mining machine as set forth in claim 1 which includes, a cutter chain supported for rotation on said cutter chain carrying bar and said chain guide member, roller means rotatably mounted on said cutter chain carrying bar for taking up slack generated in said cutter chain, said roller means extending outwardly from said chain guide member, and said chain guide member being movable relative to said roller means into engagement with said roller means to take up slack in said cutter chain.

3. A mining machine as set forth in claim 2 which includes, guide slots in said chain guide member for receiving said roller means, said roller means being positioned in said guide slots for pivotal movement into and out of engagement with said cutter chain, and actuating means connected to said roller means for moving said roller means relative to said chain guide member into engagement with said cutter chain upon movement of said chain guide member to said retracted position to take up the slack generated in said cutter chain.

4. A mining machine as set forth in claim 1 which includes, at least one sprocket rotatably positioned on said chain guide member, a cutter chain reeved about said sprocket and movably supported on said cutter chain carrying bar, drive means mounted on said mobile frame and connected to said sprocket for rotating said sprocket to drive said cutter chain, and said cutter chain being movable with said chain guide member and said cutter chain carrying bar vertically and laterally relative to said mobile frame to enlarge the cutting path of said cutter chain.

5. A mining machine as set forth in claim 1 which includes, a second chain guide member positioned laterally and to one side of said cutter chain carrying bar, said first mentioned chain guide member positioned laterally and on the opposite side of said cutter chain carrying bar, and said first mentioned chain guide member and said second chain guide member synchronously movable with said cutter chain carrying bar laterally thereof to a preselected position corresponding to said preselected position of said cutter chain carrying bar.

6. A mining machine as set forth in claim 1 which includes, a gear box positioned on said mobile frame, said first mentioned cutter chain carrying bar positioned above said gear box, a second cutter chain carrying bar positioned below said gear box for upward and downward movement on said mobile frame, said first mentioned chain guide member and a second chain guide member positioned for relative lateral movement on opposite sides of said first mentioned cutter chain carrying bar, a third chain guide member and a fourth chain guide member positioned for relative lateral movement on opposite sides of said second cutter chain carrying bar, and each of said chain guide members being laterally movable synchronously on said respective cutter chain carrying bars upon upward and downward movement of said cutter chain carrying bars.

7. A mining machine as set forth in claim 1 in which, said control link having a first end portion pivotally connected to said mobile frame front end portion, said control link having a second end portion pivotally connected to said chain guide member, and said control link being movable in an arcuate path about said first end portion upon actuation of said power means to initiate straight line horizontal movement of said chain guide member between said fully extended and fully retracted positions as said cutter chain carrying bar moves upwardly and downwardly on said mobile frame front end portion.

8. A mining machine as set forth in claim 1 in which, said power means includes a piston cylinder assembly having an extensible portion connected to said cutter chain carrying bar, means associated with said piston cylinder assembly for maintaining movement of said cutter chain carrying bar along a vertical path upon actuation of said piston cylinder assembly to extend and retract said cutter chain carrying bar on said mobile frame front end portion, and said control link being pivoted upon actuation of said piston cylinder assembly to move said chain guide member along a horizontal path on said cutter chain carrying bar to a preselected position corresponding to said preselected position of said cutter chain carrying bar.

* * * * *